United States Patent [19]

Metzen

[11] Patent Number: 4,920,621

[45] Date of Patent: May 1, 1990

[54] APPARATUS AND METHOD FOR FINISHING A TRAVELING TEXTILE FABRIC WEB

[75] Inventor: Heinz Metzen, Monchen-Gladbach, Fed. Rep. of Germany

[73] Assignee: A. Monforts GmbH & Co., Fed. Rep. of Germany

[21] Appl. No.: 256,058

[22] Filed: Oct. 11, 1988

[30] Foreign Application Priority Data

Oct. 12, 1987 [DE] Fed. Rep. of Germany ..... 3734455

[51] Int. Cl.[5] ..... D06C 27/00

[52] U.S. Cl. ..... 26/18.6; 26/18.5

[58] Field of Search ..... 26/18.5, 18.6

[56] References Cited

U.S. PATENT DOCUMENTS

| | | | |
|---|---|---|---|
| 3,940,833 | 3/1976 | Troope et al. | 26/18.6 |
| 4,031,596 | 6/1977 | Joy | 26/18.6 |
| 4,041,581 | 8/1977 | Diggle, Jr. | 26/18.6 |
| 4,058,874 | 11/1977 | Hausner | 26/18.6 X |
| 4,112,559 | 9/1978 | Troope et al. | 26/18.6 |
| 4,118,841 | 10/1978 | Diggle, Jr. | 26/18.6 |
| 4,156,955 | 6/1979 | Joy | 26/18.6 |
| 4,162,563 | 7/1979 | Lawrence et al. | 26/18.6 X |
| 4,247,969 | 2/1981 | Diggle, Jr. et al. | 26/18.6 |
| 4,446,606 | 5/1984 | Lawrence | 26/18.6 |
| 4,562,627 | 1/1986 | Milligan | 26/18.5 |
| 4,575,909 | 3/1986 | O'Brien et al. | 26/18.6 |

FOREIGN PATENT DOCUMENTS

| | | | |
|---|---|---|---|
| 2627707 | 12/1977 | Fed. Rep. of Germany . | |
| 3213716 | 10/1983 | Fed. Rep. of Germany | 26/18.6 |
| 0632779 | 7/1980 | U.S.S.R. | 26/18.6 |
| 1397521 | 6/1975 | United Kingdom | 26/18.6 |

*Primary Examiner*—Henry S. Jaudon
*Assistant Examiner*—Bradley K. DeSandro
*Attorney, Agent, or Firm*—Shefte, Pinckney & Sawyer

[57] ABSTRACT

A method and apparatus for shrink finishing a traveling textile fabric web includes a fabric drawing-in unit, a wetting unit, a fabric stetching unit, a fabric shrinking unit, and a fabric drying unit. Individual drives for each unit are provided, with the drive for the shrinking unit being the main drive and being operated as a function of the lengthwise elongation of the fabric web by the stretching unit to achieve a desired overall degree of lengthwise shrinkage of the fabric web. Automatic control of the system is provided by digital synchronization of the several drives and through moisture sensors which monitor the moisture content in the fabric web in advance of the shrinking unit and after the drying unit and by tension sensors which monitor the actual tension in the web intermediate each successive pair of the units.

14 Claims, 2 Drawing Sheets

APPARATUS AND METHOD FOR FINISHING A TRAVELING TEXTILE FABRIC WEB

BACKGROUND OF THE INVENTION

The present invention relates to the finishing of textile fabric webs by a shrinkage treatment and, more particularly, to such a shrink finishing system of the type wherein a textile fabric web travels from a fabric intake unit to a fabric wetting unit, therefrom to a fabric stretching unit for producing a corresponding reduction in fabric widthwise dimension, therefrom to a compressive shrinking unit for lengthwise fabric shrinkage, and therefrom to a fabric drying unit.

In the shrink finishing treatment of textile fabric webs in shrink finishing systems of the aforementioned type, several criteria should be observed. The fabric web should be wetted with a predetermined moisture content, including a finishing agent, e.g. a lubricating agent, in advance of shrink treatment. The fabric web should also be reduced in its widthwise dimension to a desired finished width. Likewise, the fabric web should be shrunk lengthwise to a predetermined degree. After drying of the shrunk fabric, a predetermined moisture content should remain in the fabric web. The observance of predetermined shrinkage values in shrink finishing of fabric webs is necessary to provide uniform shrinkage properties in compliance with standards suitable for the garment fabrication industry and also to provide desired wearing and ease-of-care properties for articles of clothing manufactured from the fabric web. The above-mentioned parameters apply basically to the finishing of both woven and knitted fabric webs. However, the aforementioned type of shrink-finishing systems to which the present invention relates are preferably utilized for the treatment of woven fabrics.

Heretofore, in the operation and control of a shrink finishing system of the aforementioned type, an untreated fabric web to be shrink finished is initially subjected to a wash test prior to treatment in the shrink finishing system. From the wash test, a percentage contraction of the fabric in its lengthwise, i.e. warpwise direction, which may be designated as EK, is determined and, likewise, a percentage contraction of the fabric web in its widthwise, i.e. weftwise direction, which may be designated as ES, is also determined. A garment manufacturer or other purchaser of the fabric web may specify that the fabric web as delivered to the purchaser must have a predetermined percentage residual warpwise shrinkage, designated as RK, and a predetermined percentage residual weftwise shrinkage, designated RS. Accordingly, the fabric web in such cases must be subjected to a shrink finishing treatment to shrink the fabric web lengthwise by a percentage amount, designated V, equal to the difference between the warpwise test shrinkage EK and the desired residual shrinkage RK, i.e., V (%) equals EK minus RK. Similarly, since the residual weftwise shrinkage corresponds to a certain finished width, designated as B, of the fabric web after the finishing treatment, the system must be operated such that the fabric web after treatment has a finished width equivalent to the dimensional value B.

The residual warpwise and weftwise percentage shrinkage values should of course not exceed maximum allowable tolerances either in excess of or less than the predetermined desired residual shrinkage values. As will be understood, if the residual shrinkage values are too great, the garment or other article produced from the fabric web will experience a greater than desirable shrinkage when ultimately washed, which of course is undesirable to the ultimate purchaser. On the other hand, if the residual shrinkage values are too small, the fabric web has been excessively shrunk resulting in an unnecessary effective loss of fabric.

To achieve an optimal shrink finishing treatment of any given type of fabric web utilizing a shrink finishing system of the aforementioned type, it is therefore necessary, as aforementioned, to establish and conform to a predetermined desired initial moisture content in the fabric web imparted by the wetting unit, a predetermined desired longitudinal tensioning of the fabric web by the elongation unit, a predetermined shrinkage compression of the fabric web by the shrinking unit, and a predetermined final moisture content of the fabric web after drying by the drying unit. Additionally, a predetermined traveling speed V, e.g. in meters per minute, should be established, such speed being determined by the prevailing fabric contact pressure and residence time of the fabric web in the shrinking unit. Conventionally, adherence to the above-mentioned predetermined values has been achieved by manually setting adjustable controls in the shrink finishing system, frequently monitoring actual fabric shrinkage by means of measuring marks placed initially on the untreated fabric, and making manual correcting adjustments as necessary. As will be recognized, this method of manual setting, monitoring and correction is highly service-intensive, especially inasmuch as a modification of one system control may influence other aspects of the treatment system. For example, a modification of the degree of fabric elongation to adjust the finished widthwise dimension of the fabric necessarily also affects the lengthwise shrinkage of the fabric web so that the settings controlling the warpwise fabric web shrinkage must also be adjusted.

SUMMARY OF THE INVENTION

It is accordingly an object of the present invention to provide an improved method and apparatus adapted for automatically controlling the shrink finishing of a traveling textile fabric web based upon certain input values, e.g., the predetermined desired moisture content in the fabric web at the beginning and conclusion of the finishing treatment, the desired fabric traveling speed, the desired degree of overall fabric shrinkage, and the predetermined desired width of the finished fabric, thereby to assure a more uniform and better reproducible finished fabric result than with the conventional manual control of such values while also achieving considerable savings in servicing costs.

Briefly summarized, the method and apparatus of the present invention basically utilizes an arrangement for drawing a fabric web to be treated into the apparatus, an arrangement for wetting the fabric web, an arrangement for lengthwise elongation of the fabric web for producing a corresponding reduction of the widthwise dimension of the fabric web, an arrangement for compressively shrinking the fabric web in its lengthwise dimension, and an arrangement for drying the fabric web. According to the present invention, an arrangement is provided for driving the lengthwise fabric shrinking arrangement as a function of the lengthwise elongation of the fabric web by the elongation arrangement. In this manner, a desired degree of lengthwise shrinkage of the fabric web is achieved while automatically taking into consideration the warpwise lengthening of the web which is necessary to achieve the desired reduction of the web width.

In the preferred embodiment of the invention, theoretical values are predetermined for certain parameters necessary for obtaining a desired finishing and shrinking effect on the fabric web and the predetermined theoretical values are utilized for automatically maintaining, monitoring and correcting the operation of the shrink finishing system.

In the present invention, individual respective drives are provided for each of the drawing-in arrangement, the wetting arrangement, the elongation arrangement, the shrinking arrangement, and the drying arrangement, with the drive for the shrinking arrangement functioning as the master or lead drive. The drawing-in, wetting, elongation, shrinking and drying arrangements are disposed for fabric web travel sequentially thereto, with a tension sensor disposed between each successive pair of the arrangements for sensing fluctuations in the tension of the traveling fabric web and controlling certain of the individual drives to automatically synchronize the arrangements in conformity to a predetermined desired tension value in the fabric web. Preferably, each tension sensor is a floating fabric guide roll arranged to move in opposite directions in response to increases and decreases in the tension of the fabric web.

A first moisture sensor is arranged for sensing the moisture content of the fabric web immediately in advance of the shrinking arrangement and is operatively associated with the wetting arrangement for control thereof in relation to the sensed moisture content of the fabric web. A second moisture sensor is arranged for sensing the moisture content of the fabric web immediately following the drying arrangement and is operatively associated with the drying arrangement for controlling its drying temperature.

Each of the individual drives is adjustable for controlling the degree of overall lengthwise shrinkage of the fabric web. As will be understood, the drive for the elongation arrangement is operated for a greater traveling speed of the fabric web at the elongation arrangement than at the drawing-in arrangement in relation to the degree of fabric elongation produced. Likewise, the drive for the drying arrangement is operated for a lesser traveling speed of the fabric web at the drying arrangement than at the elongation arrangement in relation to the degree of fabric web shrinkage by the shrinking arrangement. The individual drives are respectively adjusted to set a desired overall lengthwise shrinkage of the fabric web as a function of the difference between the increase in fabric web traveling speed between the drawing-in arrangement and the elongation arrangement and the decrease in fabric web traveling speed between the elongation arrangement and the drying arrangement.

A measuring device is provided for measuring the finished width of the fabric web following the second moisture sensor and is operatively associated with the elongation arrangement for controlling the degree of lengthwise fabric web elongation and the corresponding degree of reduction of the widthwise fabric web dimension. Preferably, the elongation arrangement has separate drives for entrance and exit fabric drive rollers with the drives being operated at differential speeds to achieve the desired fabric elongation, the measuring device being operatively connected with the exit drive. The elongation arrangement also includes a series of fabric web guide rollers arranged between the entrance and exit rollers, certain of the guide rollers preferably being selectively positionable obliquely with respect to the remainder of the guide rollers.

The tension sensor provided between the shrinking arrangement and the drying arrangement is operatively associated with the shrinking arrangement for controlling its shrinking compression exerted on the fabric web in relation to a predetermined degree of lengthwise fabric web shrinkage by the shrinking arrangement.

DESCRIPTION OF THE PREFERRED EMBODIMENT

Figure 1:
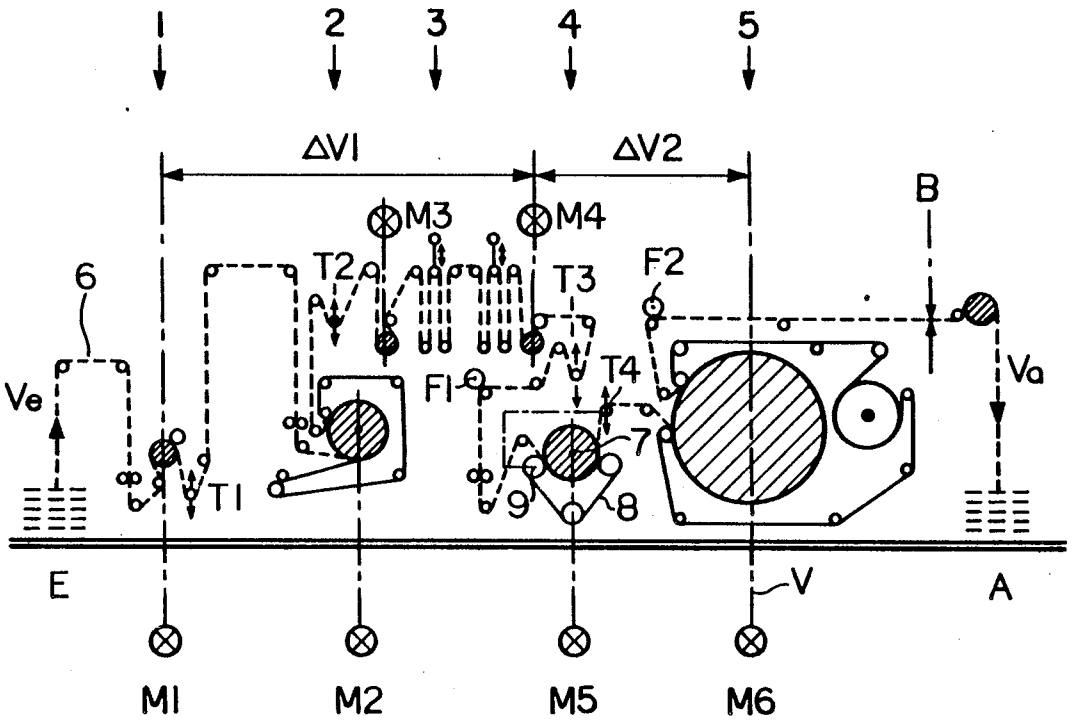
FIG. 1 is a schematic view of a shrink finishing apparatus for a traveling textile fabric web, in accordance with the preferred embodiment of the present invention.

Referring now to the accompanying drawings and initially to FIG. 1, a shrink finishing apparatus according to the preferred embodiment of the present invention is shown schematically and basically includes a fabric intake arrangement, generally indicated at 1, for drawing a fabric web 6 into the apparatus at an entrance location E, a fabric moistening arrangement, generally indicated at 2, for wetting the fabric web, a fabric stretching arrangement, generally indicated at 3, for lenghtwise elongation of the fabric web 6 to produce a corresponding reduction of the widthwise dimension of the fabric web 6, a compressive-type fabric shrinking arrangement, generally indicated at 4, for shrinking the fabric web 6 in its lengthwise dimension, and a fabric drying arrangement 5 for removing a proportion of the added moisture from the fabric web 6 and discharging the finished fabric web 6 to an exit location A.

Figure 3:
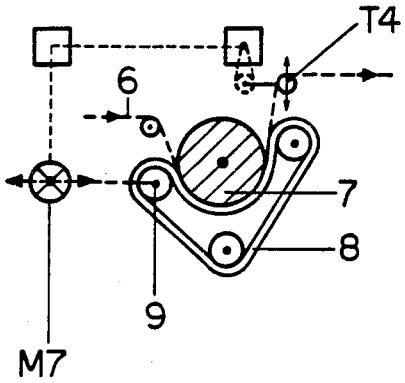
FIG. 3 is a more detailed schematic view of the shrinking arrangement of the apparatus of FIG. 1.

The individual unit arrangements 1, 2, 3, 4, 5 of the present shrink finishing system may be of conventional construction, which should not require detailed description. Briefly described, the fabric intake arrangement 1 basically includes a series of fabric guide rolls, one of which is driven by a separate respective drive M1. The fabric wetting arrangement 2 includes a cylindrical drum driven by a separate respective drive M2 with an endless belt trained in peripheral surface contact with the drum, the fabric being frictionally transported through the wetting device between the drum and belt. The fabric stretching arrangement 3 includes a series of fabric guide rolls 10,11,12 about which the fabric web 6 is trained sequentially in a sinuous path, the entrance and exit rolls 10, 11, respectively, being driven by separate respective drives M3, M4 at differential speeds to produce lengthwise elongation and widthwise contraction of the fabric web 6. The fabric shrinking arrangement 4 includes a rotatable shrinking drum 7 having an endless elastic belt 8 trained about guide and tension rollers 9 to travel in compressive peripheral surface contact with the shrinking drum, the wetted and elongated fabric web 6 being guided to travel between the elastic belt 8 and the shrinking drum 7 to be subjected to a mechanical shrinking action resulting from the compressive action of the tensioned elastic belt. As seen in FIG. 3, a motor M7 is associated with one tension roller 9 of the elastic belt arrangement for selectively moving the tension roller toward and away from the shrinking drum for correspondingly adjusting the compressive pressure exerted between the elastic belt and the shrinking drum to control the degree of warpwise shrinkage of the fabric web. The shrinking drum is separately driven by its own individual drive M5. The fabric drying arrangement 5 may be a calendering unit of the type having a relatively large diameter cylindrical heated calender drum separately driven by its own respective drive M6 with an endless belt, e.g. of an absorbent material such as felt, guided by a series of guide rolls in peripheral surface contact with the drum for frictionally transporting the fabric web 6 between the drum and the belt.

As will be understood, the drive M5 for the fabric shrinking arrangement 4 is set to achieve the desired fabric traveling speed for the desired production rate of the shrink finishing apparatus which may be designated as speed V, and serves as the master reference drive in relation to which the individual drives M1, M2, M3, M4 and M6 are set to, in turn, regulate the moisture content imparted to the fabric web 6 by the wetting arrangement 2, the desired finished width of the fabric web 6 achieved by the degree of fabric elongation between the separately driven guide rolls of the stretching arrangement 3 and a desired overall degree of lengthwise shrinkage of the finished fabric web 6 at the discharge location A.

In order to maintain the driven components of the drawing-in, moistening, stretching, shrinking and drying arrangements 1, 2, 3, 4, 5 and their respective drives M1, M2, M3, M4, M5, M6 in proper synchronism with one another, sensors T1, T2, T3, T4 are arranged intermediate each successive pair of the arrangements in the described sequence to detect deviations in the traveling speed of the fabric web 6 and, in turn, to control the respective drives of the preceding arrangements to correct for detected deviations. Specifically, the sensor T1 is arranged for monitoring the travel of the fabric web 6 between the drawing-in arrangement 1 and the wetting arrangement 2. The sensor T2 is arranged for monitoring the traveling fabric web 6 between the wetting arrangement 2 and the stretching arrangement 3. The sensor T3 is arranged to monitor the traveling web 6 between the stretching arrangement 3 and the shrinking arrangement 4. The sensor T4 is arranged to monitor the traveling fabric web 6 between the shrinking arrangement 4 and the drying arrangement 5.

Figure 2:
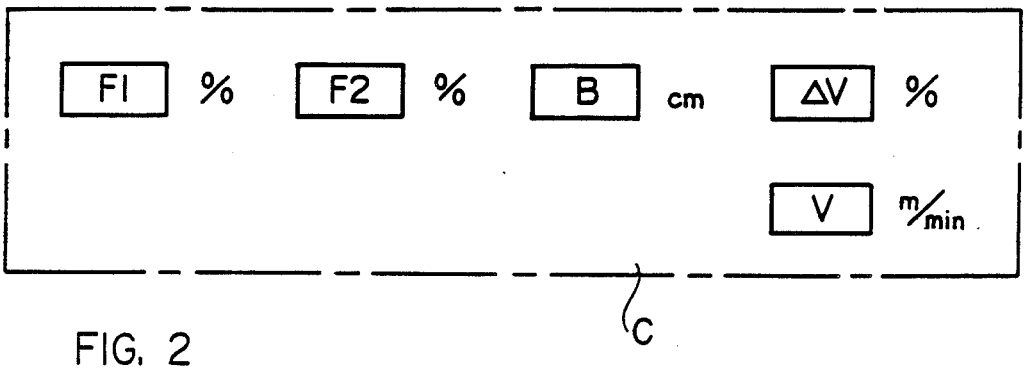
FIG. 2 is a schematic view of the central control unit for the shrink finishing apparatus of FIG. 1.

Preferably, each sensor T1–T4 is a tension sensing mechanism such as a floating dancer roll arranged in peripheral engagement with the traveling fabric web 6 for movement in opposite directions in response to increases and decreases in the prevailing web tension. The tension values determined by the sensors T1, T2, T3, T4 are supplied to a central controller, representatively shown at C in FIG. 2, which monitors the tension values fed from the tension sensors and automatically adjusts operation of the drive M1 in response to tension deviations detected by the sensor T1, likewise adjusts operation of the drive M2 in response to tension deviations detected by the sensor T2, adjusts operation of one or both the drives M3, M4 in response to tension deviations detected by the sensor T3, and adjusts the motor M7 in response to tension fluctuations detected by the sensor T4, to correct for the sensed tension deviations according to a predetermined operational program stored by the controller C.

A first moisture sensor F1 is arranged for monitoring the moisture content of the web 6 immediately in advance of the shrinking arrangement 4 and, similarly, a second moisture sensor F2 is arranged for monitoring the moisture content of the web 6 immediately following the drying arrangement 5. The moisture sensors F1, F2 may of course be of any suitable conventional construction. A measuring device, representatively indicated at B, which may be of any appropriate construction, is arranged to monitor the finished width of the web 6 following the second moisture sensor F2. Each of the moisture sensors F1, F2 and the measuring device B are operatively connected with the central controller C to supply their respectively detected values to the controller C. The controller C, in turn, is arranged to adjust operation of the drive M2 to the wetting arrangement 2 in response to deviations in the moisture content of the web 6 detected by the first moisture sensor F1 so as to maintain a uniform moisture content in the web 6 as it enters the shrinking arrangement 4. Similarly, the controller C is operatively associated with the drying arrangement 5 to adjust its drying temperature in response to deviations in the fabric web 6 exiting the drying arrangement 5 as detected by the second moisture sensor F2, in order to maintain a uniform residual moisture content in the finished fabric web 6. The controller C is operatively associated with one or both of the drives M3, M4 of the stretching arrangement 3 to adjust the degree of lengthwise web elongation by the stretching arrangement 3 in response to deviations in the finished width as detected by the measuring device B in order to maintain a uniform widthwise dimension in the finished fabric web 6 exiting the drying arrangement 5.

In normal operation of the present invention, a fabric web 6 should enter the shrink finishing system at a predetermined intake speed, which may be designated Ve as shown in the drawing, and should exit the system at the discharge location A at a predetermined slower speed, which may be designated Va as also shown in the drawing. As will be understood, the exiting speed Va represents the overall production speed of the entire system, previously identified as V. The intake speed Ve will be understood to coincide with the surface speed of the driven web-engaging components of the drawing-in arrangement 1 as controlled by its drive M1 and, likewise, the exiting speed Va, i.e. the overall production speed V, coincides with the surface speed of the driven calender drum of the drying arrangement 5 as controlled by its drive M6. Thus, the actual shrinking and finishing process carried out by the system occurs along the path of web travel between the drawing-in arrangement 1 and the drying arrangement 5.

It will be understood that the fabric web 6 will undergo a lengthwise elongation in traveling from the drawing-in arrangement 1 through the wetting arrangement 2 and the stretching arrangement 3, due principally to the fabric elongation imposed by the differential speeds of the drives M3, M4 of the stretching arrangement 3 and, secondarily, to lesser lengthwise dimensional changes occurring in the web 6 as it travels through the wetting arrangement 2. Thus, the traveling speed of the web 6 must increase from the drawing-in arrangement 1 to the point of web exit from the stretching arrangement 3, which speed increase may be designated as $\Delta V1$, as shown in FIG. 1. Conversely, as the fabric web 6 travels through the shrinking arrangement 4 and the drying arrangement 5, the web 6 undergoes a reduction in warpwise length so that the traveling speed of the web must be reduced along this extent of the web travel commensurate with the degree of fabric shrinkage, which may be designated ΔV2, as also shown in FIG. 1. Thus, in order to achieve an overall shrinkage of the fabric web 6 from its original condition entering the drawing-in arrangement 1, the value ΔV2 must be greater that the value ΔV1. As aforementioned, the actual desired net fabric shrinkage of the fabric web 6, which may be designated as ΔV, is the difference between the total lengthwise shrinkage of the web as determined by a standard wash test, designated as the value EK, and the predetermined residual warpwise shrinkage desired in the fabric web after shrink finishing, designated as the value RK, which may be represented mathematically as: $EK-RK=\Delta V$ (%).

Accordingly, the difference by which the value ΔV2 exceeds the value ΔV1 must equal the value ΔV in order to achieve the predetermined desired overall shrinkage of the web 6. Thus, the value ΔV represents the net shrinkage of the fabric web in its lengthwise, i.e. warpwise, direction, expressed as a percentage of the original web length, which is necessary to counteract the lengthwise elongation of the fabric web 6 by the stretching unit 3 (which is required to obtain the desired finished width of the web) and to further shrink the fabric web 6 lengthwise to leave the desire percentage of residual fabric web shrinkage RK originally determined through the standardized washing test.

Under the present invention, the describe shrink finishing system will operate automatically to be self-monitoring and self-correcting to achieve the desired fabric shrinkage. For this purpose, the central controller C is provided with suitable controls for presetting the desired moisture content for the fabric web at each of the moisture sensors F1, F2, the desired finished width of the web at the measuring device B, the desired overall net lengthwise shrinkage ΔV of the fabric web, and the desired output speed V for the system. Once these five values have been preset at the controller C, the system follows the following mode of self-monitoring and self-correcting operation:

(a) The first moisture sensor F1 continuously monitors the moisture content in the fabric web 6 immediately in advance of the shrinking arrangement 4 and the controller C adjusts operation of the wetting device 2 in response to the moisture sensor F1, as above described, in order to correct for deviations in the actual detected moisture content from the preset desired moisture content. Similarly, the second moisture sensor F2 monitors the actual moisture content in the fabric web immediately following the drying arrangement 5 and the controller C adjusts operation of the drying arrangement 5 to regulate the drying temperature it generates to correct for deviations in the actual moisture content in the web from the preset desired moisture content.

(b) The controller C controls the respective drives M1, M2, M3, M4, M5, M6, with the control of the drive M5 to the shrinking unit 4 being the master reference, so that the desired overall production speed V for the system is achieved. The desired lengthwise elongation of the web 6 is accomplished by the stretching arrangement 3 to obtain the desired finished width of the web 6 and the necessary speed differential between the value ΔV2 and the value ΔV1 is obtained to achieve the desired predetermined overall percentage shrinkage of the fabric web 6. To best achieve this mode of operation, it is preferred that the individual drives M1, M2, M3, M4, M5, M6 be direct current drive motors which are individually connected operatively with the main controller C for monitoring the actual respective operational speeds of the motors in a conventional impulse counting manner and for digital synchronization control of the individual motors by the controller C. Specifically, each drive is provided with an impulse generator to produce a predetermined number of impulses per driven motor revolution, the controller C being arranged to count the impulses produced by each drive to monitor its speed and to digitally maintain the individual drive speeds in proper synchronization.

(c) The measuring device B continuously monitors the actual width of the fabric web 6 exiting the drying arrangement 5 and supplies an actual width value to the controller C which, in the event of a deviation in the actual width value from the predetermined desired value set at the controller C, adjusts the drive M4 to the stretching arrangement 3 to increase or decrease the surface speed of the exit drive roll to, in turn, increase or decrease the degree of fabric elongation produced by the stretching unit 3 and, as a result, to adjust the degree of widthwise contraction of the fabric web 6 by the stretching arrangement 3, thereby to correct for deviations in the desired finished width of the fabric web 6 from the desired width value originally preset at the controller C. Alternatively, the drive M3 to the intake roll of the stretching arrangement 3 may be adjusted to achieve the same result. As a further alternative, the intake roll of the stretching arrangement 3 may be provided with a braking device rather than a separate drive M3, with the braking device being controlled to adjust the degree of elongation of the fabric web. bp (d) The tension sensors T1, T2, T3, T4, continuously monitor the actual tension prevailing in the fabric web 6 intermediate the successively arranged drawing-in, wetting, stretching, shrinking, and drying arrangements 1, 2, 3, 4, 5 and, as aforementioned, supply sensed tension values to the controller C which, in turn, adjusts the operation of the respective preceding drives to correct for deviations in the web tension from a predetermined desired tension level. Particularly, the controller C is responsive to the tension sensor T4 to adjust operation of the motor M7 to increase or decrease the compression of the fabric web 6 exerted between the elastic belt and the shrinking drum of the shrinking arrangement 4. In this manner, the degree of lengthwise shrinkage of the fabric web 6 and, in turn, the web tension at the sensor T4 are adjusted.

(e) As will be understood, it is possible in certain instances that the shrinking arrangement 4 may be adjusted to exert the maximum possible amount of compression on the fabric web 6, but the desired degree of overall fabric web shrinkage ΔV still is not achieved. In such instances, the controller C adjusts the various drives of the shrink finishing system to reduce the production speed V of the system until the overall degree of fabric web shrinkage ΔV is achieved at the discharge location A. As will be understood, the other settings of the controller C, e.g., the finished residual moisture content in the fabric web as determined at the second moisture sensor F2 or the finished fabric web width as determined at the measuring device B, do not require change or individual regulation in this instance since the system control as aforementioned still operates to provide for such corrections.

Figure 4:
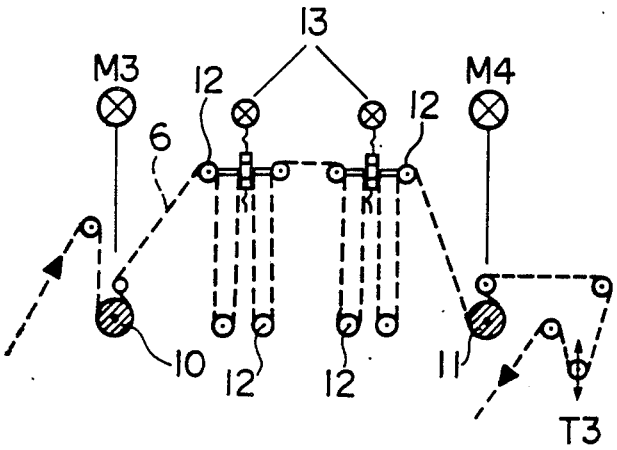
FIG. 4 is a more detailed schematic view of the elongation arrangement of the apparatus of FIG. 1.
Figure 5:
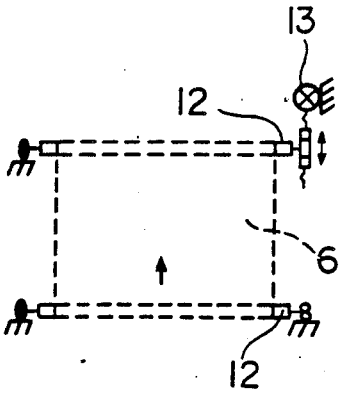
FIG. 5 is an elevational view of the elongation arrangement of FIG. 4.

(f) As will be seen in FIGS. 4 and 5, the upper and lower fabric web guide rollers of the stretching arrangement 3 may preferably be mounted to permit either or both the upper and lower sets of guide rollers to be adjustably positioned obliquely with respect to the other set of rollers, as necessary or desirable in a special instance, to vary the angular disposition of the weft yarns of the fabric web in relation to its warp yarns. Specifically, as illustrated by way of example with respect to the upper rollers 12 in FIGS. 4 and 5, one end of each of the rollers is supported in a fixed disposition while the other end of each roller is associated with a control actuator 13 to move upwardly and downwardly with respect to the first end and in turn to be oriented obliquely with respect to the lower rollers 12. As will be understood, however, the aforedescribed automatic operation of the shrink finishing system is not and need not be affected in such circumstance.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for finishing a traveling textile fabric web comprising means for drawing the fabric web into the apparatus, means for wetting the fabric web, means for lengthwise elongation of the fabric web for producing a corresponding reduction of the widthwise dimension of the fabric web, means for compressively shrinking the fabric web in its lengthwise dimension, means for drying the fabric web, said drawing-in means, said wetting means, said elongation means, said shrinking means, and said drying means being arranged for fabric web travel sequentially thereto, means for sensing the moisture content of the fabric web immediately following said drying means and operatively associated with said drying means for controlling the drying temperature thereof, means for measuring the width of the fabric web following said moisture sensing means following said drying means and operatively associated with said elongation means for controlling the degree of lengthwise fabric web elongation and the corresponding degree of reduction of widthwise fabric web dimension, and individual respective driving means for each of said drawing-in means, said wetting means, said elongation means, said shrinking means, and said drying means, said driving means for said shrinking means being arranged as a master driving means and being operative for driving said shrinking means as a function of the lengthwise elongation of the fabric web by said elongation means to achieve a desired degree of lengthwise shrinkage of the fabric web.

2. An apparatus for finishing a textile fabric web according to claim 1 and characterized further by means for sensing the tension of the fabric web between said drawing-in means and said wetting means, between said wetting means and said elongation means, between said elongation means and said shrinking means, and between said shrinking means and said drying means for controlling the fabric web tension in conformity to a predetermined tension value.

3. An apparatus for finishing a textile fabric web according to claim 2 and characterized further in that said means for sensing fabric web tension between said shrinking means and said drying means is operatively associated with said shrinking means for controlling its shrinking compression exerted on said fabric web in relation to a predetermined degree of lengthwise fabric web shrinkage by said shrinking means.

4. An apparatus for finishing a textile fabric web according to claim 1 and characterized further by means for sensing the moisture content of the fabric web immediately in advance of said shrinking means and operatively associated with said wetting means for control thereof in relation to the sensed moisture content of the fabric web.

5. An apparatus for finishing a textile fabric web according to claim 1 and characterized further in that each said individual driving means is adjustable for controlling the degree of overall lengthwise shrinkage of said fabric web, said driving means for said elongation means being operated for a greater traveling speed of said fabric web at said elongation means than at said drawing-in means in relation to the degree of fabric elongation and said driving means for said drying means being operated for a lesser traveling speed of said fabric web at said drying means than at said elongation means in relation to the degree of fabric web shrinkage by said shrinking means, said individual driving means being respectively adjusted to set a desired overall lengthwise shrinkage of the fabric web as a function of the difference between the increase in fabric web traveling speed between said drawing-in means and said elongation means and the decrease in fabric web traveling speed between said elongation means and said drying means.

6. An apparatus for finishing a textile fabric web according to claim 1 and characterized further in that each said individual driving means comprises a direct-current drive and means for impulse counting to monitor the respective speed of each drive and for digital synchronization of said drives with respect to one another.

7. An apparatus for finishing a textile fabric web according to claim 1 and characterized further in that said driving means for said elongation means comprises a speed control device at an entrance location to said elongation means and a drive at an exit location from said elongation means, said width measuring means being operatively connected to said exit drive.

8. An apparatus for finishing a traveling textile fabric web comprising means for drawing the fabric web into the apparatus, means for wetting the fabric web, means for lengthwise elongation of the fabric web for producing a corresponding reduction of the widthwise dimension of the fabric web, means for compressively shrinking the fabric web in its lengthwise dimension, means for drying the fabric web, and means for driving said shrinking means as a function of the lengthwise elongation of the fabric web by said elongation means to achieve a desired degree of lengthwise shrinkage of the fabric web, said elongation means comprising a series of fabric web guide rollers arranged between entrance and exit fabric speed control rollers, and means for selectively positioning a portion of said guide rollers obliquely with respect to the other said guide rollers.

9. A method for finishing a traveling textile fabric web comprising the steps of wetting the fabric web, elongating the fabric web lengthwise for producing a corresponding reduction of the widthwise dimension of the fabric web, compressively shrinking the fabric web in its lengthwise dimension, drying the fabric web, sensing the moisture content of the fabric web immediately following said drying, controlling the drying temperature of said drying in relation to the sensed moisture content, measuring the width of the fabric web following said moisture sensing following said drying, controlling said elongating in relation to the measured fabric web width to control the degree of lengthwise fabric web elongation and the corresponding degree of reduction of the widthwise fabric web dimension, and controlling said shrinking as a function of the lengthwise elongation of the fabric web to achieve a desired degree of lengthwise shrinkage of the fabric web.

10. A method for finishing a textile fabric web according to claim 9 and characterized further by sensing the tension of the fabric web in advance of said wetting, between said wetting and said elongating, between said elongating and said shrinking, and between said shrinking and said drying, and controlling the fabric web tension in conformity to a predetermined tension value.

11. A method for finishing a textile fabric web according to claim 10 and characterized further by controlling said shrinking in relation to the sensing of fabric web tension between said shrinking and said drying for controlling shrinking compression exerted on said fabric web in relation to a predetermined degree of lengthwise fabric web shrinkage by said shrinking.

12. A method for finishing a textile fabric web according to claim 11 and characterized further by reducing the traveling speed of the fabric web when a maximum amount of shrinking compression is exerted on the fabric web without achieving the predetermined degree of lengthwise fabric web shrinkage.

13. A method for finishing a textile fabric web according to claim 9 and characterized further by sensing the moisture content of the fabric web immediately in advance of said shrinking and controlling said wetting in relation to the sensed moisture content of the fabric web.

14. A method for finishing a textile fabric web according to claim 9 and characterized further by imparting an increased traveling speed to said fabric web during said elongating in relation to the degree of fabric elongation, imparting a decreased traveling speed of said fabric web during said drying in relation to the degree of fabric web shrinkage by said shrinking and controlling a desired overall lengthwise shrinkage of the fabric web as a function of the difference

* * * * *